US006410869B1

(12) United States Patent
McNutt

(10) Patent No.: US 6,410,869 B1
(45) Date of Patent: Jun. 25, 2002

(54) BRANCH ASSEMBLY FOR A COMMUNICATION BUS

(75) Inventor: Leon J. McNutt, Winona, MN (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 76 days.

(21) Appl. No.: 09/589,782

(22) Filed: Jun. 8, 2000

(51) Int. Cl.[7] ..... H01R 33/96

(52) U.S. Cl. ..... 200/51 R; 200/51.09; 200/51.1

(58) Field of Search ..... 200/1 R, 17 R, 200/51 R, 51.02, 51.03, 51.05, 51.06, 51.09, 51.11, 51.12, 51.1

(56) References Cited

U.S. PATENT DOCUMENTS

| | | | | |
|---|---|---|---|---|
| 3,553,395 A | | 1/1971 | White | 200/18 |
| 3,665,495 A | | 5/1972 | Carter et al. | 307/67 |
| 3,697,709 A | | 10/1972 | Wiktor | 200/48 R |
| 3,936,782 A | | 2/1976 | Moakler et al. | 335/161 |
| 4,157,461 A | | 6/1979 | Wiktor | 200/18 |
| 4,295,054 A | | 10/1981 | Kovatch et al. | 307/80 |
| 4,423,336 A | | 12/1983 | Iverson et al. | 307/64 |
| 4,882,554 A | * | 11/1989 | Akaba et al. | 333/105 |
| 5,233,501 A | * | 8/1993 | Allen et al. | 361/733 |
| 5,648,745 A | * | 7/1997 | Spriester et al. | 333/100 |
| 5,721,449 A | | 2/1998 | Panuce | 200/14 |
| 5,898,239 A | | 4/1999 | Kawam | 307/130 |
| 5,909,154 A | * | 6/1999 | Brown et al. | 333/100 |
| 5,914,467 A | | 6/1999 | Jonas et al. | 200/1 R |

OTHER PUBLICATIONS

John Goldie; Ten Ways to Bulletproof RS–485 Interfaces; National Semiconductor Application Note 1057; Oct. 1996; pp. 1–4; National Semiconductor Corporation.

* cited by examiner

*Primary Examiner*—Michael Friedhofer
(74) *Attorney, Agent, or Firm*—Blumenfeld, Kaplan & Sandweiss, P.C.

(57) ABSTRACT

A branch assembly for a communication bus is shown that allows easy connection and removal of devices from the bus. A switch is located within each assembly to direct the bus either from one bus interface directly to a second bus interface or from one bus interface through a branch interface to the second bus interface, as appropriate depending on the presence of device at the branch interface. The switch is integrated into the assembly and is mechanically actuated by the presence or absence of a connector at the branch interface.

13 Claims, 3 Drawing Sheets

BRANCH ASSEMBLY FOR A COMMUNICATION BUS

FIELD OF THE INVENTION

The present invention relates to electrical busses generally, and more particularly to a branch assembly for attaching devices such busses.

BACKGROUND OF THE INVENTION

It is very common today for electrical devices to communicate with one another. For example, is frequently desirable to allow devices that receive information to pass that information to a controlling device for logging and/or processing. The processing device can then pass control commands to another device.

A thermal system is a prime example of a series of devices that need to communicate with another. A plurality of temperature acquisition devices are strategically located throughout the system, each having some type of temperature sensor (e.g. thermocouple, RTD) directly attached thereto. The temperature acquisition devices send temperature data back to one ore more control systems. Some of the control systems may be used for remote monitoring purposes only, while others may actively control the thermal processes. The active control systems then send command signals to power supplies, each having one or more electrical heaters attached thereto.

This communication among the different devices is typically done on electrical busses. The busses comprise a series of electrical conductors that run from one device to the next. Each of the conductors may have a different purpose. Some may be used to control the communication process, while others may be used to send bits of binary data. Still other conductors are sometimes needed for electrical grounding purposes.

Many bus designs and communication protocols for the same are conventional and standard. Some examples of well-known standardized bus designs include RS-232, RS-422, RS-423, and RS-485. Each of these standards, which are maintained by the Electronic Industries Association (EIA) and/or the Telecommunications Industry Association (TIA), specify a certain number of conductors in the bus, how devices (or "nodes") on the bus may connect to the bus, and several other similar operating parameters.

Some bus designs, such as RS-485, allow multiple nodes on the same bus. The ideal configuration for such buses is to have the conductors run from one node to only one other node in a given line ("daisy chained"). Although in theory there should be no branches at all, in practice every time a node is placed on the bus a short branch, known as a stub, is inevitably created. The stubs on an RS-485 bus should be kept as short as possible, and should never exceed 6 inches. Configurations that violate this rule may still work, but are prone to frequent communication problems. Examples of proper RS-485 configurations are located in *Ten Ways to Bulletproof RS*-485 *Interfaces* (National Semiconductor Application Note 1057) published by the National Semiconductor Corporation in October 1996.

In the past, it has been known to include multiple bus connection points on devices. To connect the device to the bus, the conductors coming from the previous device are attached to one connection point on the new device and the conductors from the next device are attached to the other connection point. One obvious disadvantage of this connecting method is that anytime a new node/device is added to the bus, bus wiring must be rerouted. It also requires the devices to be built with the multiple connection points. Furthermore, the multiple connection points necessarily means that there is a small stub on the last device. This stub at the end of the bus must be electrically terminated for the bus to function properly at high data transmission speeds.

Another solution has been to use repeaters along the bus at branch points. Each repeater must have a separate power source, however. That is not only inconvenient, but sometimes not even feasible.

SUMMARY OF THE INVENTION

It is in view of the above problems that the present invention was developed.

The invention thus has an object to provide a quick and easy connector for communication busses that leaves practically no stubs.

It is another object of the present invention to allow the addition or removal of devices from a communication bus with minimal interruption to the bus.

It is a further object of the present invention to provide means for attaching portable devices to a communication bus without the need for power consuming devices such as repeaters.

In keeping with the above objects, the present invention is a branch assembly for a communication bus that automatically reroutes the bus when a node is added or removed. The assembly comprises a housing with three connection points and an integral switch. Two of the connection points are for the main bus interface. The remaining connection is a branch interface for the optional addition of a new branch to the bus configuration. The addition at the branch interface may be a single node, or it may be a long series of nodes already properly connected.

An integral switch which is actuated by the addition or removal of a connector at the branch interface reroutes the connectors in the assembly accordingly. When no connector is located at the branch interface, the switch remains in a closed position, allowing the conductors at the bus interfaces to be directly connected to one another. Likewise, when a connector is located at the branch interface, the switch opens. This forces the electrical circuit of the conductors to pass through the new branch or node in its path from one bus interface to the other.

BRIEF DESCRIPTION OF THE DRAWINGS

The above-mentioned and other features, advantages and objects of this invention, and the manner in which they are obtained will become more apparent and will be best understood by reference to the detailed description in conjunction with the accompanying drawings which follow, wherein.

DETAILED DESCRIPTION OF THE DRAWINGS

Figure 1:
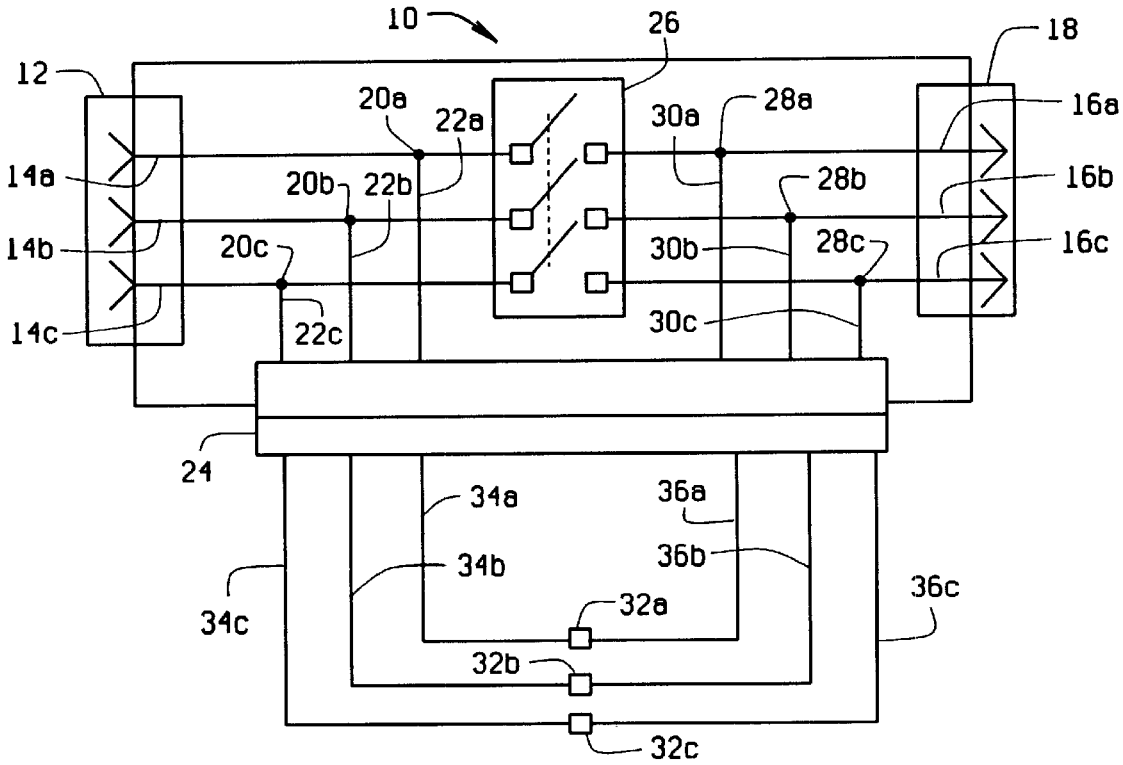
FIG. 1. is an electrical circuit diagram of the assembly of the present invention.

Referring now to FIG. 1, the electrical circuit 10 of the assembly of the present invention is shown generally. The circuit 10 has a plurality of input conductors 14*a*, 14*b*, and 14*c* (collectively 14) at an input bus interface 12. It also has a plurality of output conductors 16*a*, 16*b*, and 16*c* (collectively 16) at an output bus interface 18. The terms input and output are used for the sake of clarity only; many bus designs that could utilize the present invention are bi-directional, meaning the data can travel either direction on the same conductors. It should also be noted that while three conductors are shown by way of example, the present invention has no theoretical limit to the number of conductors with which it would work. The number of conductors is a function of the bus specifications and would even work on a single-conductor bus.

The input conductors 14 branch at input junctions 20*a*, 20*b*, and 20*c* respectively (collectively 20). Stemming from the input junction are input branch conductors 22*a*, 22*b*, and 22*c* (collectively 22), which end at branch interface 24. The input conductors 10 continue on to switch 26. The switch 26 has a number of poles (at least) equal to the number of conductors used. In the present example a triple pole switch would be needed as three conductors are being used. The switch is preferably single-throw for the reason that will become apparent below.

On the opposite side of the switch 26 from the input conductors 14 are the output conductors 16. Similar to the input side, the output side has output junctions 28*a*, 28*b*, and 28*c* (collectively 28). Stemming from the output junctions 28, are output branch conductors 30*a*, 30*b*, and 30*c* (collectively 30), which run to the branch interface 24.

At the branch interface 24, input node conductors 34*a*, 34*b*, and 34*c* (collectively 34) and output node conductors 36*a*, 36*b*, and 36*c* (collectively 36) may optionally be connected. The input and output node conductors 34 and 36 both terminate at the optional device 52 at termination points 32*a*, 32*b*, and 32*c*. This optional device 52 may be any type of device normally used on such a communication bus, such as a sensor, a control, or a power supply by way of example.

The switch 26 is collectively actuated by the addition or removal of conductors at the branch interface 24. When conductors are connected at the branch interface 24, the switch 26 is open (as shown in FIG. 1). Hence, the circuit path of each individual conductor of the bus flows from the input conductor 14 to the input branch conductor 22 to the input node conductor 34 to the added device at termination point 32 to the output node conductor 36 to the output branch conductor 30 to the output conductor 16. As can be seen, the only stubs here from the junctions 20 and 28 to the open switch 26, which measures insignificantly on the order of millimeters.

When the optional device is removed and the conductors are removed from the branch interface 24, the switch 26 automatically closes. The circuit path of each individual conductor of the bus then flows the input conductor 14 through the switch 26 to the output conductor 16. Now the only stubs are the input and output branch conductors 22 and 30—again running an insignificantly short length.

Figure 2:
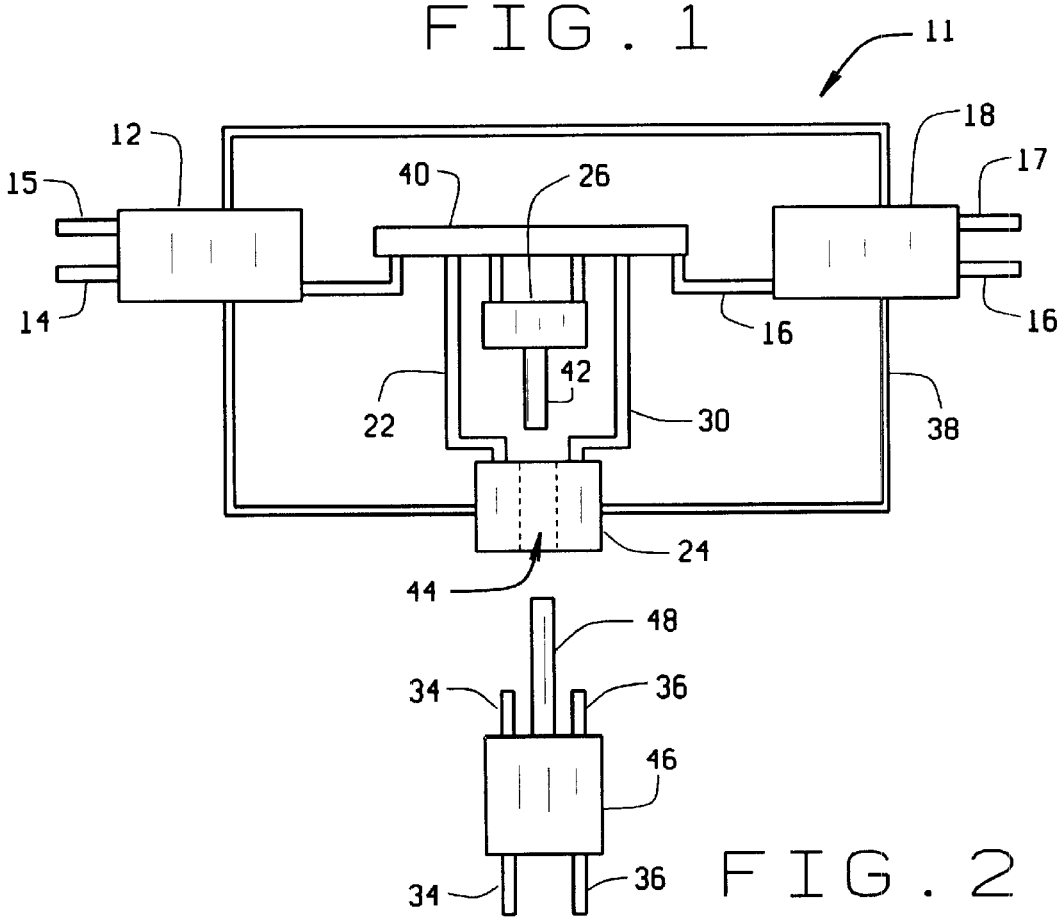
FIG. 2 is schematic diagram of the mechanical aspects of the assembly of the present invention.

FIG. 2 shows the mechanical relationship of the various components of the assembly 11 in general. The assembly comprises a housing 38, with an input bus interface 12, and output bus interface 18, and a branch interface 24. The input and output conductors 14 and 16 and the input and output branch conductors 22 and 30 preferably run to a small circuit board 40 upon which junctions 20 and 28 and switch 26 are located.

The bus interfaces 12 and 18 are preferably, but not necessarily, the same physical form as the branch interface 24. For instance, in the case where three conductors are used, the interfaces 12, 18, and 24 may all be standard DIN-6 connectors. In this case, the branch interface 24 obviously uses twice as many conductors as the bus interfaces 12 and 18. Therefore, there will be unused input conductors 15 and unused output conductors 17 on the bus interfaces 12 and 18 respectively.

The switch 26 has an actuator 42 that extends to a location just inside the housing 11 from the branch interface 24. It should be aligned with an opening 44 on the branch interface 24. The end of the connector 46 for the branch device should also have switch-activating tip 48 that aligns with the opening 44. Thus, when the connector 46 is inserted into the branch interface 24 the tip 48 contacts the actuator 42, which opens the switch 26.

Figure 3:
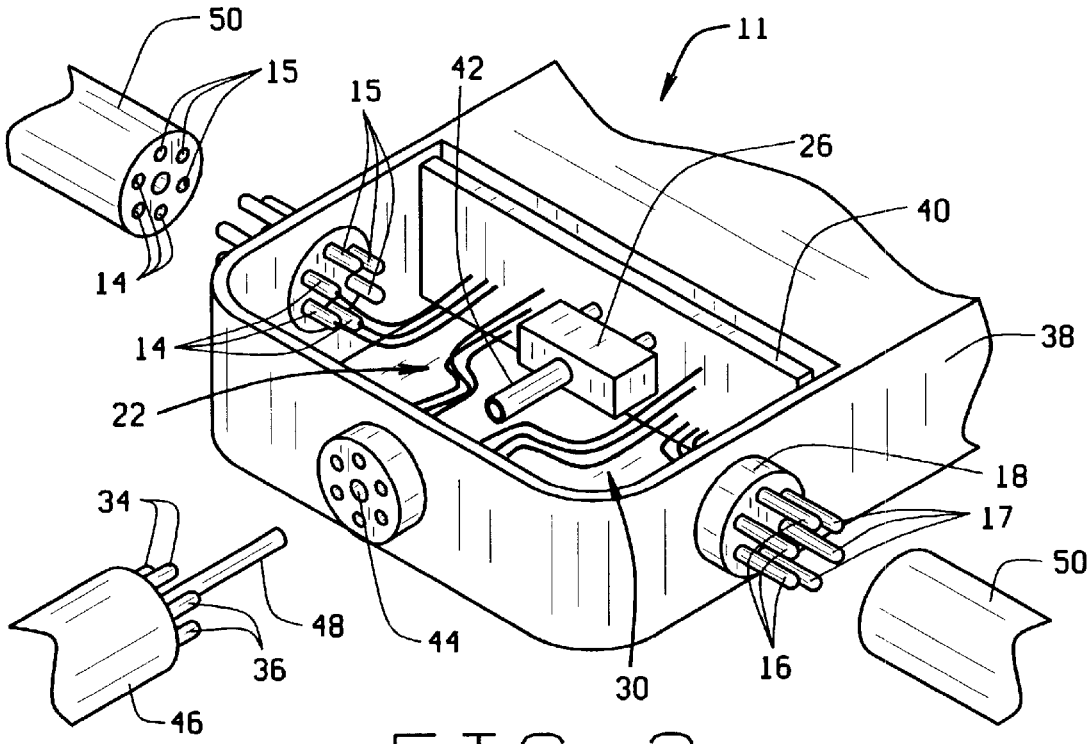
FIG. 3 is an isometric view the assembly of the present invention with wiring unplugged from the connection interfaces.
Figure 4:
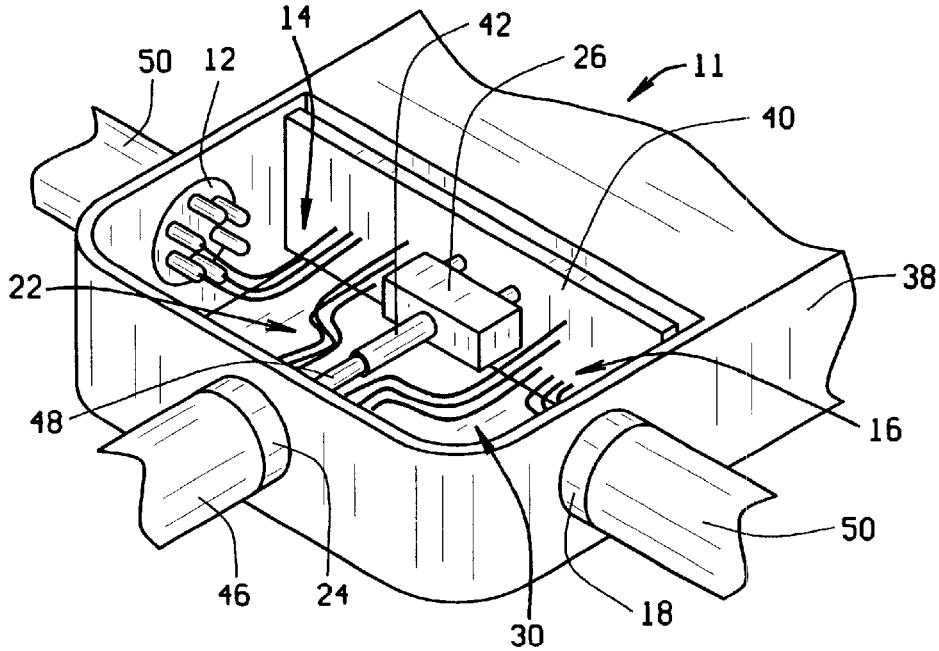
FIG. 4 is an isometric view similar to FIG. 3, but with the wiring plugged into the connection interfaces.

FIGS. 3 and 4 similarly shows an exemplary embodiment of the assembly 11. FIG. 3 shows the assembly 11 with the bus connectors 50 and the branch connector 46 removed. FIG. 4 is identical, but with the connectors 46 and 50 inserted.

Thus can be seen that devices may be added to the bus with minimal, if any, interruption, and all stubs are kept to a negligible distance. A plurality of the assemblies may be installed at different locations during wiring, so that the bus may be expanded with additional devices at a later date with no need for rewiring or the acquisition of repeaters.

Termination is readily accomplished by connecting the last device on either end of the bus to a branch interface of any of the assemblies. Any conventional termination apparatus may then be permanently placed on the unused bus interface of the last assembly on either end of the bus.

Figure 5:
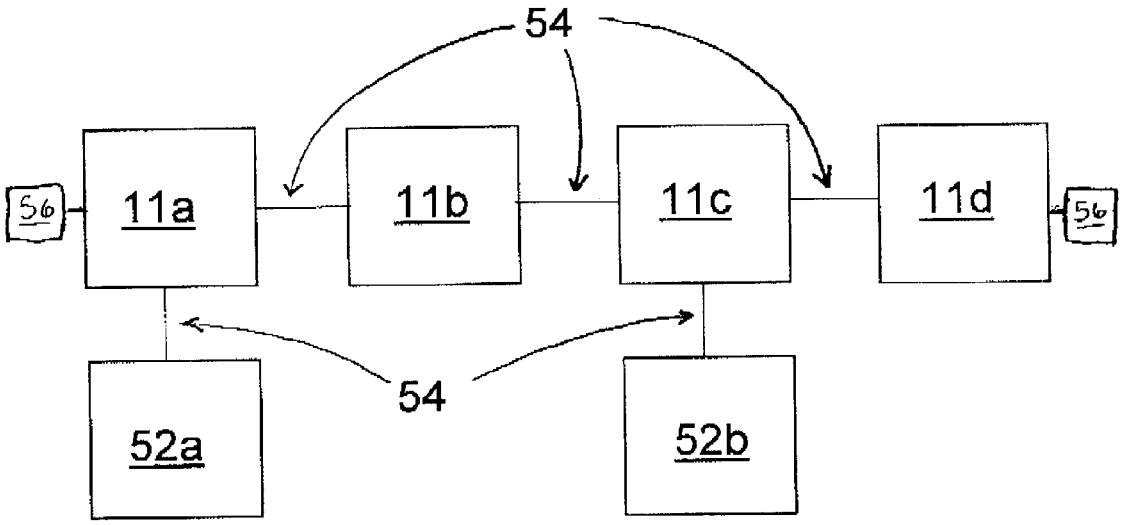
FIG. 5 is a schematic view of a plurality of assemblies connected in a logical sequence.

FIG. 5 shows the logical assembly described in the preceding two paragraphs. As should be readily understood from the preceding description, a plurality of assemblies 11 are chained together, forming the bus. The first assembly is designated 11*a*, the second 11*b*, and so forth. The first bus interface 12 from each assembly 11 is connected by conventional wiring 54 to the second bus interface 18 of the ensuing assembly 11. As described, the first and last assemblies (11*a* and 11*d*) are terminated by placing a conventional termination device 56 on the appropriate bus interfaces thereof. Any conventional device 52 may be attached to the bus, but conventionally wiring it to a connector 48, and inserting the connector 48 into the branch interface 24 of any assembly 11 along the bus. Selection of such wiring and termination is clearly a routine matter to one of ordinary skill.

Accordingly, while this invention is described with reference to a preferred embodiment of the invention, it is not intended to be construed in a limiting sense. It is rather intended to convey many variations, uses, or adaptations in the invention utilizing its general principles. Various modifications will be apparent to persons skilled in the art upon reference to this description. It is therefore contemplated that the appended claims will cover any such modifications or embodiments as fall within the true scope of the invention.

I claim:

1. A branch assembly for an electrical bus, comprising:

a housing, a first and a second bus interface disposed on a periphery of said housing;

a branch interface disposed on the periphery of said housing;

a switch disposed within said housing, said switch having an open and a closed state;

a first set of at least one electrical conductors extending from said first bus interface to said switch and a second set of electrical conductors equal in number to said first set, said second set extending from said second bus interface to said switch;

a third set of electrical conductors equal in number to said first set, said third set of electrical conductors extending between said first set of electrical conductors and said branch interface, said third set of electrical conductors in electrical communication with said first set of electrical conductors;

a fourth set of electrical conductors equal in number to said second set, said fourth set of electrical conductors extending between said second set of electrical conductors and said branch interface, said fourth set of electrical conductors in electrical communication with said second set of electrical conductors;

an actuator located on said switch placing said switch in the closed state when said branch interface is unoccupied and placing said switch in the open state when said branch interface is occupied; and wherein said switch places said first set of electrical conductors in electrical communication with the corresponding electrical conductors of said second set when said switch is in the closed state, and prevents any electrical communication between the first and second set of electrical conductors when said switch is in the open state.

2. The assembly of claim 1, further comprising a circuit board mounted within said housing, whereupon said switch is located.

3. The assembly of claim 2, wherein the connections between said first and third sets of electrical conductors and the connections between said second and fourth sets of electrical conductors are located on said circuit board.

4. The assembly of claim 3, wherein said bus interfaces and said branch interface are of like shape and size.

5. The assembly of claim 4, wherein said bus interfaces have means to receive female connectors, and said branch interface has means to receive a male connector.

6. The assembly of claim 3, further comprising an opening in said branch interface, said opening aligned with said switch actuator.

7. The assembly of claim 6, wherein said actuator is operated by a protrusion from a connector on the branch interface.

8. The assembly of claim 3, wherein said bus interface and said branch interface are of necessary shape and size to be used with an RS-485 communication bus.

9. A communication bus comprising:

a plurality of branch assemblies placed in a logical sequence, each of said branch assemblies comprises:

a housing;

a first and a second bus interface disposed on a periphery of said housing;

a branch interface disposed on the periphery of said housing;

a switch disposed within said housing, said switch having an open and a closed state;

a first set of at least one electrical conductors extending from said first bus interface to said switch and a second set of electrical conductors equal in number to said first set, said second set extending from said second bus interface to said switch;

a third set of electrical conductors equal in number to said first set, said third set of electrical conductors extending between said first set of electrical conductors and said branch interface, said third set of electrical conductors in electrical communication with said first set of electrical conductors;

a fourth set of electrical conductors equal in number to said second set, said fourth set of electrical conductors extending between said second set of electrical conductors and said branch interface, said fourth set of electrical conductors in electrical communication with said second set of electrical conductors;

an actuator located on said switch placing said switch in the closed state when said branch interface is unoccupied and placing said switch in the open state when said branch interface is occupied; and wherein said switch places said first set of electrical conductors in electrical communication with said second set of electrical conductors when said switch is in the closed state, and prevents any electrical communication between the first and second set of electrical conductors when said switch is in the open state; and at least one cable, each cable placing said first bus interface of one assembly in electrical communication with a bus interface of an adjacent assembly.

10. The communication bus of claim 9, further comprising an electrical termination on said second bus interface of the first logically sequenced assembly and an electrical termination on said first bus interface of the last logically sequenced assembly.

11. The communication bus of claim 9, further comprising connection means for placing a communicating device in electrical communication with one of said branch interfaces.

12. The communication bus of claim 11, further comprising a protruding tip on the end of each said connector.

13. The communication bus of claim 12, further comprising an opening in at least one of said branch interfaces, said opening aligned with said actuator.

* * * * *